US008663076B2

(12) United States Patent
Chou

(10) Patent No.: US 8,663,076 B2
(45) Date of Patent: Mar. 4, 2014

(54) STRETCHING MACHINE

(75) Inventor: Yu-Chih Chou, Xiamen (CN)

(73) Assignee: Xiamen Zhoulong Sporting Goods Co., Ltd., Xiamen, Fujian Province (CN)

( * ) Notice: Subject to any disclaimer, the term of this patent is extended or adjusted under 35 U.S.C. 154(b) by 293 days.

(21) Appl. No.: 13/309,437

(22) Filed: Dec. 1, 2011

(65) Prior Publication Data

US 2012/0295780 A1 Nov. 22, 2012

(30) Foreign Application Priority Data

May 19, 2011 (CN) ..... 2011 2 0160925 U

(51) Int. Cl.
*A63B 26/00* (2006.01)

(52) U.S. Cl.
USPC ..... 482/142; 482/907

(58) Field of Classification Search
USPC ..... 482/51, 72, 73, 91, 92, 133–145, 907; 601/23, 24
See application file for complete search history.

(56) References Cited

U.S. PATENT DOCUMENTS

| | | | | |
|---|---|---|---|---|
| 5,295,935 | A * | 3/1994 | Wang | 482/130 |
| 5,997,450 | A * | 12/1999 | Wilkinson | 482/142 |
| 6,592,501 | B1 * | 7/2003 | Mayes | 482/142 |
| 7,004,894 | B1 * | 2/2006 | Trotter | 482/140 |
| 7,044,898 | B2 * | 5/2006 | Kuo et al. | 482/121 |
| 7,229,388 | B2 * | 6/2007 | Yang | 482/72 |
| 7,331,914 | B2 * | 2/2008 | Carlucci et al. | 482/148 |
| 7,722,512 | B2 * | 5/2010 | Liang et al. | 482/130 |
| 2002/0169057 | A1 * | 11/2002 | Forcillo | 482/142 |

* cited by examiner

*Primary Examiner* — Oren Ginsberg
*Assistant Examiner* — Gregory Winter

(57) ABSTRACT

A stretching machine includes a machine rack, a foot stool, a hand stool, and a lying board installed in a middle part of the machine rack. The foot stool and the hand stool are respectively installed at two ends of the machine rack. The main body of the machine rack is formed by a multisection longitudinal stretch sleeve, and a longitudinal stretch regulation mechanism is provided to retractably regulate the multisection longitudinal stretch sleeve in the longitudinal direction. By the rotation of a pull hand and the engagement of a strip gear and a round gear wheel in the longitudinal stretch regulation mechanism to extend the second sleeve relative to the first sleeve, the user on the lying board can be extended to attain the stretching of the cervical vertebra thereof.

3 Claims, 4 Drawing Sheets

STRETCHING MACHINE

BACKGROUND OF THE INVENTION

1. Field of the Invention

The invention relates to a gymnastic apparatus, in particular to a stretching machine.

2. Description of the Related Art

In general, conventional musculus abdominalis training devices are only utilized to train the human's musculus abdominalis for keeping fitness. Thus, the training for human's other parts, such as the cervical vertebra and strength of arms, shall be relied on other particular training devices.

BRIEF SUMMARY OF THE INVENTION

The purpose of the invention is to provide a stretching machine for the human, capable of stretching the musculus abdominalis and training the cervical vertebra and strength of arms.

To achieve the purposes above, the invention is adopted with the technology projects as follows. The invention is to a stretching machine comprising a machine rack, a foot stool, a hand stool and a lying board. The lying board is installed in a middle part of the machine rack, and the foot stool and the hand stool are respectively installed at two ends of the machine rack. The machine rack mainly comprises a longitudinal stretch sleeve, a front foot rack, a rear foot rack and a longitudinal stretch regulation mechanism, wherein the longitudinal stretch sleeve comprises three sleeves including a first sleeve, a second sleeve and a third sleeve. In the longitudinal stretch sleeve, the first sleeve has two ends fixedly connected to the front foot rack and the rear foot rack, the second sleeve is movably jointed in the first sleeve and retractable in the longitudinal direction relative to the first sleeve, the third sleeve has one end movably jointed in the second sleeve, the longitudinal stretch regulation mechanism installed at a middle part of the first sleeve comprises a pull hand formed as an L-shape, a round gear wheel disposed on a lower end the L-shaped pull hand, and a strip gear installed on a sidewall of the second sleeve, and the strip gear is engaged to the round gear wheel when the second sleeve is inserted in the first sleeve. The hand stool mainly comprises a swing rod and a handgrip, wherein the swing rod includes a handgrip rod, an elastic fastener and a connecting rod, the connecting rod is a pipe having a pipe wall longitudinally opened with a plurality of positioning holes and one end connected to a side surface of the first sleeve at a pivot point so that the connecting rod is capable of swinging about the pivot point, the handgrip rod formed as an L-shape includes a vertical section jointed to the handgrip and a horizontal section jointed to another end of the connecting rod, the horizontal section of the handgrip rod includes a pipe wall opened with a through hole corresponding to the positioning holes of the pipe wall of the connecting rod, the elastic fastener formed as an U-shape and providing one free end with an outwardly protruded button is jointed in a hollow chamber of the horizontal section of the handgrip rod, and the protruded button of the elastic fastener is penetrated through the through hole formed on the pipe wall of the horizontal section of the handgrip rod and one of the positioning holes of the connecting rod.

The pipe wall of the connecting rod is provided with three positioning holes.

The round gear wheel of the longitudinal stretch regulation mechanism includes two chamfered ends.

According to the above-described technology projects, the main body of the machine rack of the invention is formed by a multisection longitudinal stretch sleeve, and a longitudinal stretch regulation mechanism is provided to retractably regulate the multisection longitudinal stretch sleeve in the longitudinal direction. By the rotation of the pull hand and the engagement of the strip gear and the round gear wheel in the longitudinal stretch regulation mechanism for extending the second sleeve relative to the first sleeve, the user on the lying board can be extended to attain the stretching of the cervical vertebra. In addition, the hand stool of the invention is mainly assembled by a handgrip and a swing rod. It is convenient to adjust the length of the stretching machine for the user by means of pressing the button of the elastic fastener.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
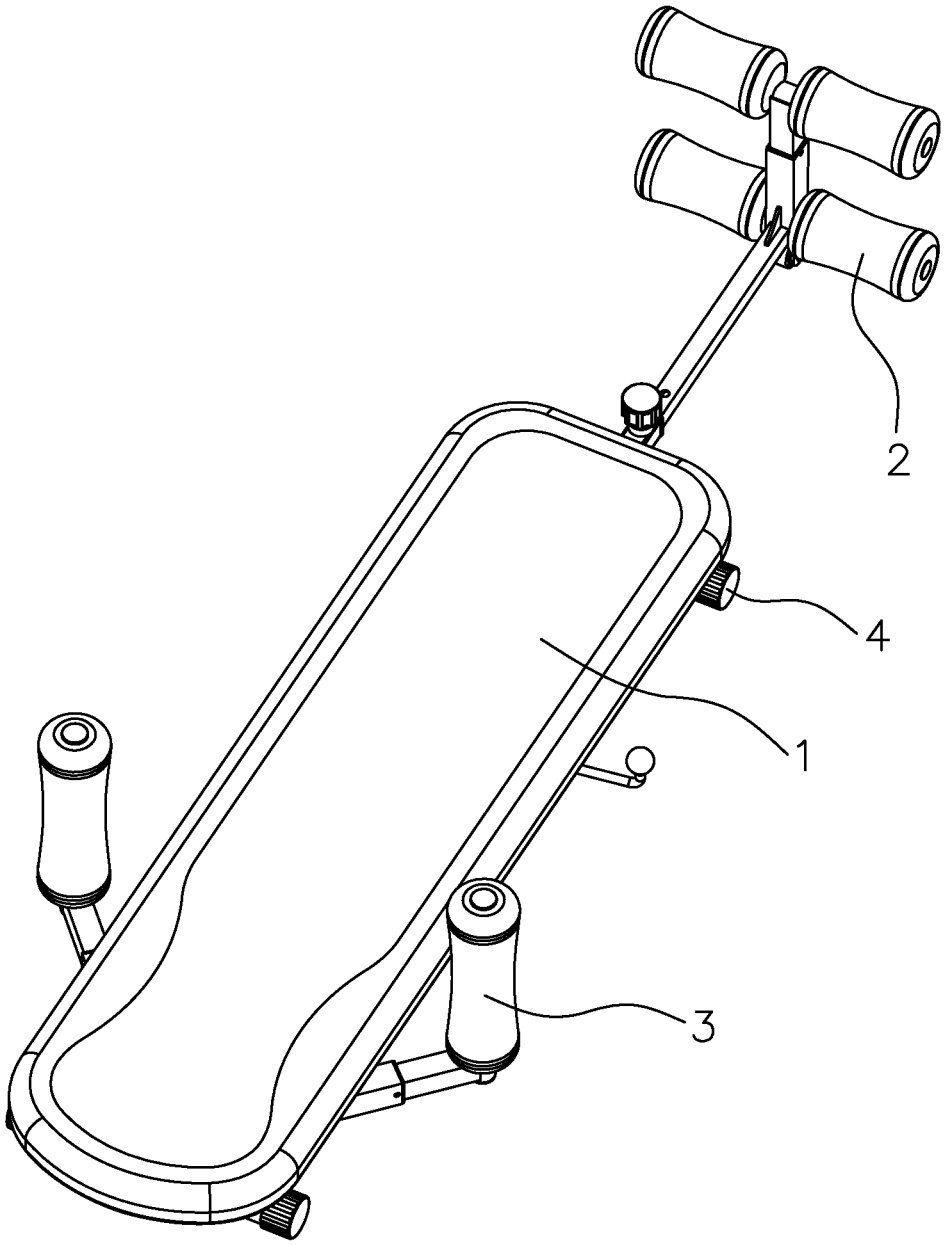
FIG. 1 is an axonometric view of the invention.
Figure 2:
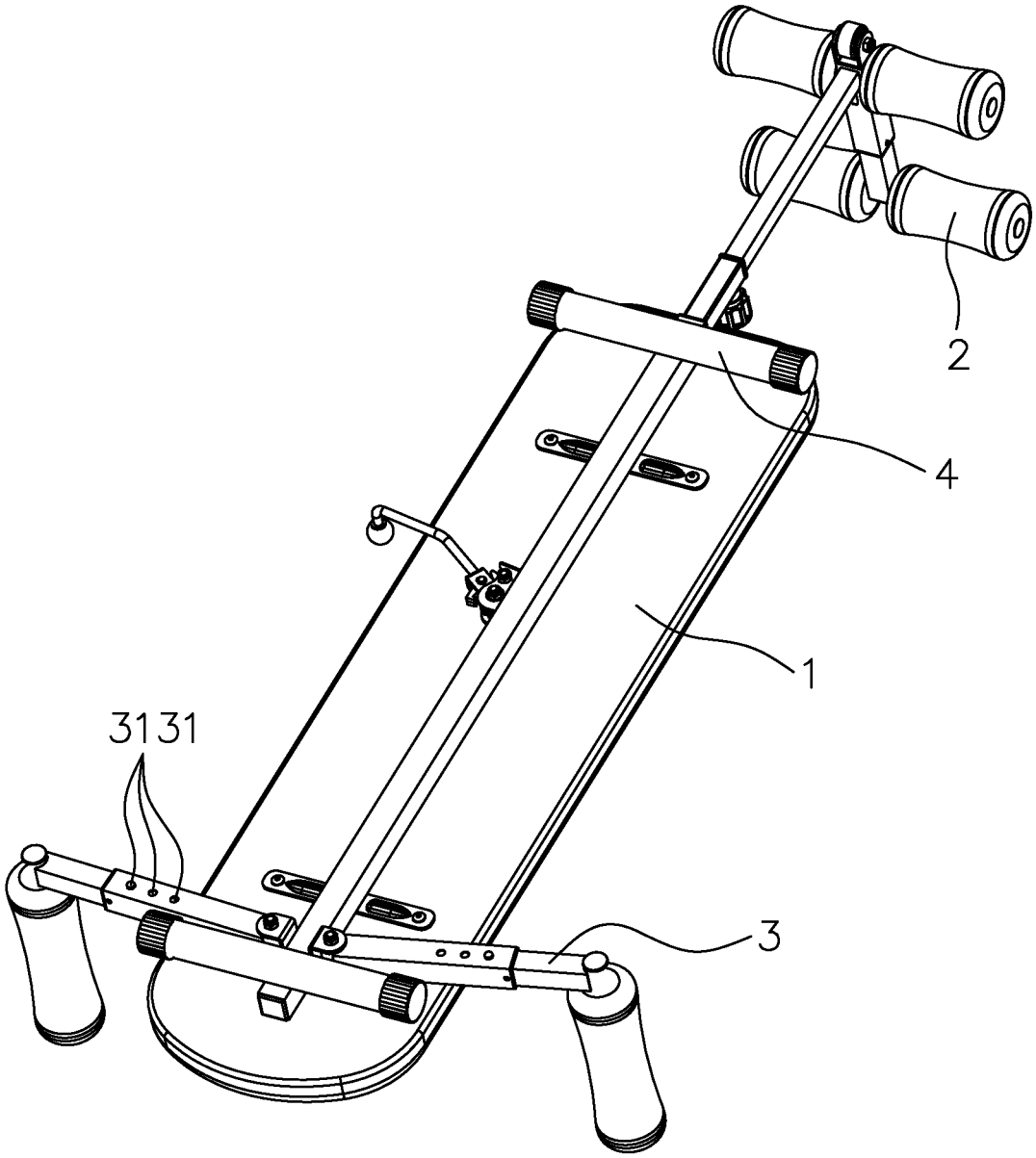
FIG. 2 is a bottom view of the invention.

As shown in FIGS. 1 and 2, a stretching machine of the invention comprises a lying board 1, a foot stool 2, a hand stool 3, a machine rack 4 and an elastic pulling rope (not shown in FIGs.).

The lying board 1 is installed in a middle part of the machine rack 4. The foot stool 2 and the hand stool 3 are respectively installed at two ends of the machine rack 4. The foot stool 2 is assembled by a handgrip 21, a fixed sleeve 22, a fixed handgrip rod 23, a movable pipe 24 and a movable pipe handgrip rod 25. The elastic pulling rope has one end connected to two ends of the fixed handgrip rod 23 of the foot stool 2.

Figure 3:
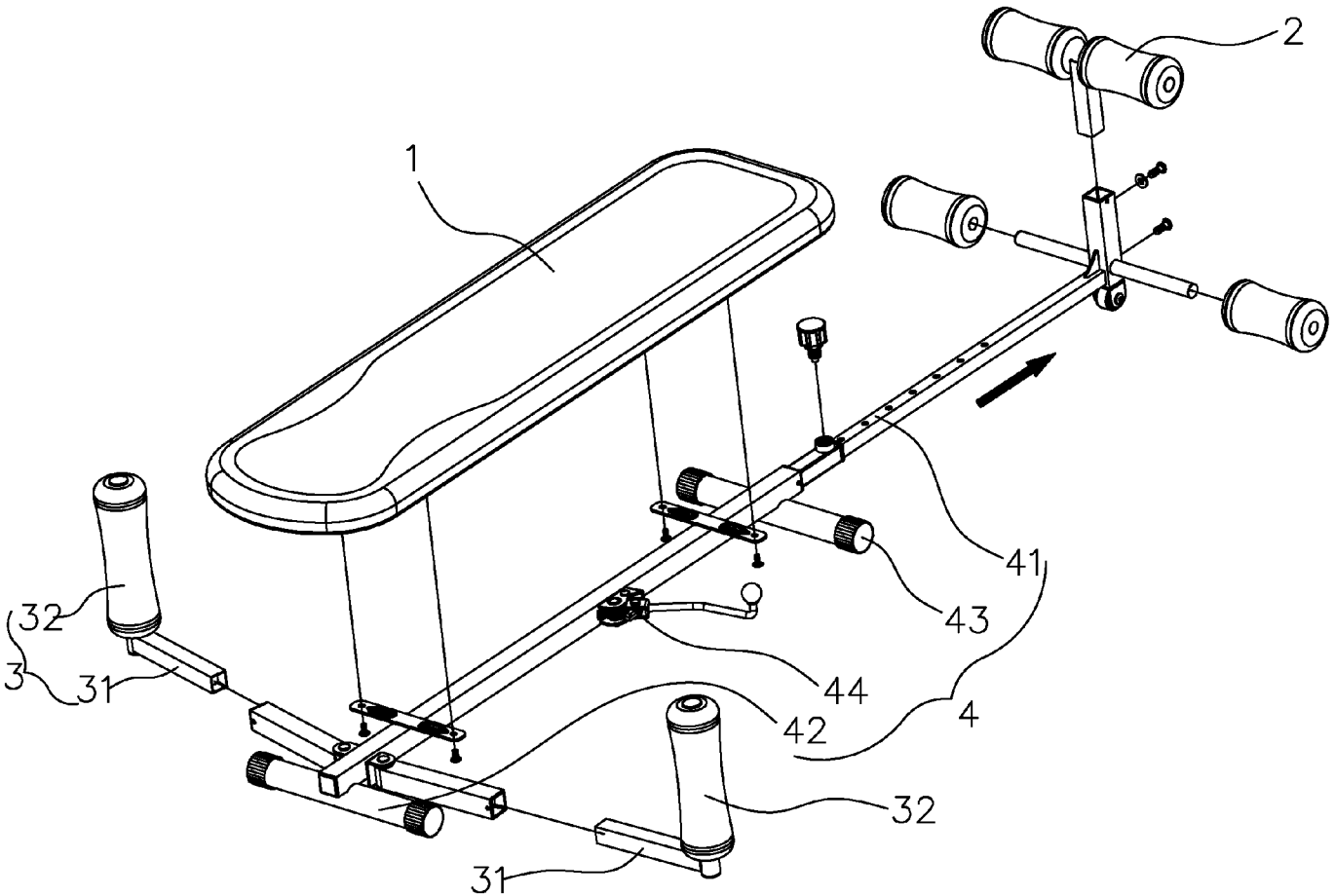
FIG. 3 is a partial exploded view of the invention.
Figure 4:
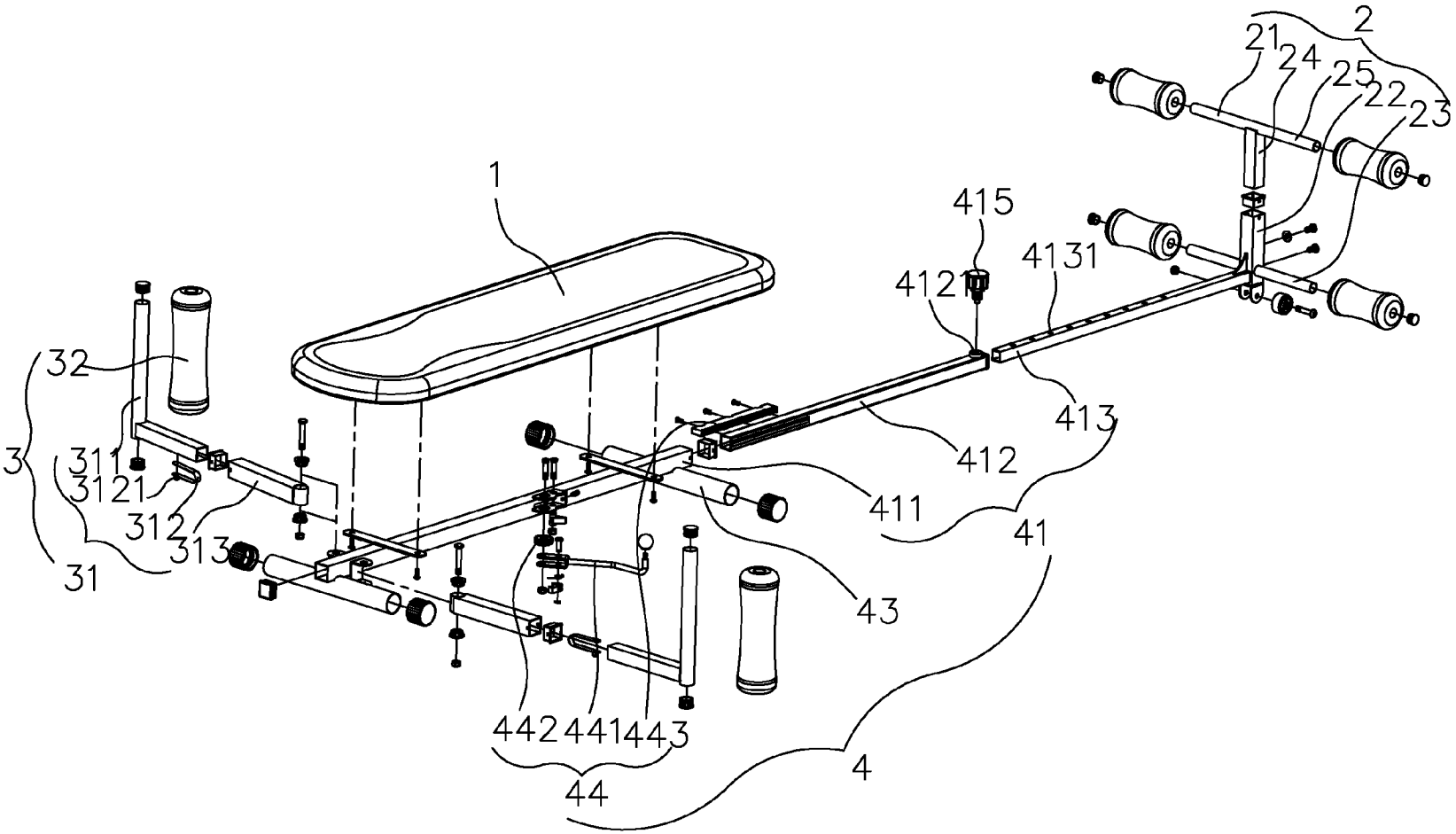
FIG. 4 is a perspective exploded view of the invention.

As shown in FIGS. 3 and 4, the machine rack 4 mainly comprises a longitudinal stretch sleeve 41, a front foot rack 42, a rear foot rack 43 and a longitudinal stretch regulation mechanism 44. The longitudinal stretch sleeve 41 is assembled by three sleeves, including a first sleeve 411, a second sleeve 412 and a third sleeve 413, wherein the first sleeve 411 has two ends fixedly connected to the front foot rack 42 and the rear foot rack 43, the second sleeve 412 which is movably jointed in the first sleeve 411 and retractable in the longitudinal direction relative to the first sleeve 411 includes a distal end provided with a positioning hole 4121, and the third sleeve 413 has one end movably jointed in the second sleeve 412 and a plurality of positioning holes 4131 which are opened in the longitudinal direction thereof to correspond to the positioning hole 4121 of the second sleeve 412. A positioning screw 415 is penetrated through the positioning hole 4121 of the second sleeve 412 and the positioning hole 4131 of the third sleeve 413 for positioning, thereby limiting the extension length of the third sleeve 413 relative to the second sleeve 412.

The longitudinal stretch regulation mechanism 44 installed at a middle part of the first sleeve 411 comprises an L-shaped pull hand 441, a round gear wheel 442 disposed on a lower end of the L-shaped pull hand 441, and a strip gear 443 installed on a sidewall of the second sleeve 412. The strip gear 443 is engaged to the round gear wheel 442 when the second sleeve 412 is inserted in the first sleeve 411. The round gear wheel 442 of the longitudinal stretch regulation mechanism 44 includes two chamfered ends.

In the foot stool 2, the fixed sleeve 22 includes a lower part having a surface fixedly connected to the machine rack 4, and the fixed handgrip rod 23 includes a middle part to be perpendicularly inserted and engaged to another surface of the lower part of the fixed sleeve 22 and two outwardly-extended ends, wherein the fixed handgrip rod 23 and the fixed sleeve 22 are crossed to each other. Further, the movable pipe 24 includes lower end movably inserted and engaged in the fixed sleeve 22, and the movable pipe handgrip rod 25 includes a middle part perpendicularly and fixedly engaged to the upper end of the movable pipe 24 and two outwardly-extended ends, wherein the movable pipe handgrip rod 25 and the upper end of the movable pipe 24 are crossed to each other. The amount of the handgrips 21 is four, which are jointed to the outwardly-extended parallel sections of the fixed handgrip rod 23 and the movable pipe handgrip rod 25, respectively. In operation, the movable pipe 24 can be lifted at a constant distance in accordance with the user's requirement.

The hand stool 3 is mainly assembled by a swing rod 31 and a handgrip 32. The swing rod 31 is assembled by an L-shaped handgrip rod 311, an U-shaped elastic fastener 312 and a connecting rod 313. The connecting rod 313 is a pipe having a pipe wall longitudinally opened with three positioning holes 3131 (shown in FIG. 2) and one end connected to a side surface of the first sleeve 411 at a pivot point so that the connecting rod 313 is capable of swinging about the pivot point. The handgrip rod 311 includes a vertical section jointed to the handgrip 21 and a horizontal section jointed to another end of the connecting rod 313, wherein the horizontal section has a pipe wall opened with a through hole corresponding to the three positioning holes of the pipe wall of the connecting rod 313. The elastic fastener 312 providing one free end with an outwardly-protruded button 3121 is jointed in a hollow chamber of the horizontal section of the handgrip rod 311, and the protruded button 3121 of the elastic fastener 312 is penetrated through the through hole formed on the pipe wall of the horizontal section of the handgrip rod 311 and one of three positioning holes of the connecting rod 313, thereby connecting the handgrip rod 311 to the connecting rod 313.

The working principle of the invention is described as follows. When the user lies on the lying board 1, with legs jointed between the fixed handgrip rod 23 and the movable pipe handgrip rod 25 of the foot stool 2 as well as with armpits clamping on the handgrips 32 of the hand stool 3, the user swings the pull hand 441 by hands thereof to rotate the round gear wheel 442, to outwardly extend the strip gear 443 which is engaged to the round gear wheel 442 and fixedly installed on the second sleeve 412 in the longitudinal direction relative to the first sleeve 411, such that the user in the longitudinally-extended condition can have the cervical vertebra be stretched. Further, it is convenient to adjust the length of the stretching machine for the user by means of pressing the button 3121 of the elastic fastener 312.

What is claimed is:

1. A stretching machine comprising a machine rack, a foot stool, a hand stool, and a lying board installed in a middle part of the machine rack, the foot stool and the hand stool respectively installed at two ends of the machine rack, the machine rack mainly comprising a longitudinal stretch sleeve, a front foot rack, a rear foot rack and a longitudinal stretch regulation mechanism, the longitudinal stretch sleeve comprising three sleeves included with a first sleeve, a second sleeve and a third sleeve, the first sleeve having two ends fixedly connected to the front foot rack and the rear foot rack, the second sleeve being movably jointed in the first sleeve and retractable in the longitudinal direction relative to the first sleeve, the third sleeve having one end movably jointed in the second sleeve, the longitudinal stretch regulation mechanism installed at a middle part of the first sleeve and comprising a pull hand formed as an L-shape, a round gear wheel disposed on a lower end of the L-shaped pull hand, and a strip gear installed on a sidewall of the second sleeve, and the strip gear being engaged to the round gear wheel when the second sleeve is inserted in the first sleeve, wherein the hand stool comprises a handgrip and a swing rod, the swing rod includes a handgrip rod, an elastic fastener and a connecting rod, the connecting rod is a pipe having a pipe wall longitudinally opened with a plurality of positioning holes and one end connected to a side surface of the first sleeve at a pivot point so that the connecting rod is capable of swinging about the pivot point, the handgrip rod formed as an L-shape includes a vertical section jointed to the handgrip and a horizontal section jointed to another end of the connecting rod, the horizontal section of the handgrip rod includes a pipe wall opened with a through hole corresponding to the positioning holes of the pipe wall of the connecting rod, the elastic fastener formed as an U-shape and providing one free end with an outwardly protruded button is jointed in a hollow chamber of the horizontal section of the handgrip rod, and the protruded button of the elastic fastener is penetrated through the through hole formed on the pipe wall of the horizontal section of the handgrip rod and one of the positioning holes of the connecting rod.

2. The stretching machine as claimed in claim 1, characterized in that the pipe wall of the connecting rod is provided with three positioning holes.

3. The stretching machine as claimed in claim 1, characterized in that the round gear wheel of the longitudinal stretch regulation mechanism includes two chamfered ends.

* * * * *